US005330886A

United States Patent [19]

Helling et al.

[11] Patent Number: 5,330,886

[45] Date of Patent: Jul. 19, 1994

[54] COLOUR PHOTOGRAPHIC RECORDING MATERIAL

[75] Inventors: Günter Helling, Odenthal; Günter Renner, Bergisch Gladbach, both of Fed. Rep. of Germany

[73] Assignee: AGFA-Gevaert AG, Leverkusen, Fed. Rep. of Germany

[21] Appl. No.: 9,952

[22] Filed: Jan. 27, 1993

[30] Foreign Application Priority Data

Feb. 7, 1992 [DE] Fed. Rep. of Germany ..... 4203532

[51] Int. Cl.[5] ..... G03C 1/76

[52] U.S. Cl. ..... 430/537; 430/505; 430/545; 430/551

[58] Field of Search ..... 430/503, 505, 537, 545, 430/551, 531

[56] References Cited

U.S. PATENT DOCUMENTS

| | | | |
|---|---|---|---|
| 4,912,023 | 3/1990 | Matsuyama et al. | 430/531 |
| 5,055,386 | 10/1991 | Hirano et al. | 430/545 |
| 5,057,405 | 10/1991 | Shiba et al. | 430/505 |

FOREIGN PATENT DOCUMENTS

| | | |
|---|---|---|
| 0382443 | 8/1990 | European Pat. Off. . |
| 2270618 | 12/1975 | France . |
| 542704 | 8/1941 | United Kingdom . |

OTHER PUBLICATIONS

Abstract (from "Orbit") of French Patent FR2270618.

*Primary Examiner*—Thomas R. Neville
*Attorney, Agent, or Firm*—Connolly & Hutz

[57] ABSTRACT

A colour photographic recording material having a support, at least one light-sensitive silver halide emulsion layer containing a pyrazoloazole magenta coupler, at least one other layer which is arranged closer to the source of light and at least one other layer arranged further away from the source of light than the silver halide emulsion layer containing the pyrazoloazole magenta coupler, these other layers containing gelatine and a randomly or alternatingly structured copolymer of vinyl alcohol and an unsaturated carboxylic acid or a graft polymer of vinyl acetate on polyalkylene oxide followed by saponification of the acetate groups is distinguished by improved stability to light of the magenta dye obtained after processing.

6 Claims, No Drawings

COLOR PHOTOGRAPHIC RECORDING MATERIAL

This invention relates to a colour photographic recording material having improved colour stability.

Colour photographic materials normally contain at least one yellow coupler, at least one magenta coupler and at least one cyan coupler from which the corresponding dyes are produced by exposure and development. These dyes, in particular the dyes which are constantly exposed to light, are required to have high colour stability and it is particularly important that the colour stability of all three colours should be as far as possible equal so that no falsification of colour occurs when there is a slight loss of colour.

At the same time, the dyes should be as colour pure as possible. For the magenta region this has led to the previously commonly used pyrazolone couplers being increasingly replaced by pyrazoloazole couplers as these lead to purer magenta tones. The dyes obtained from pyrazoloazole couplers are, however, not sufficiently stable to light compared with the usual dyes obtained from yellow and cyan couplers.

It was therefore an object of the present invention to overcome this lack of stability to light.

It has now been found that this problem can be solved by adding a randomly or alternatingly structured copolymer of vinyl alcohol and an unsaturated carboxylic acid, in particular an unsaturated mono-, di- or tricarboxylic acid, or a graft polymer of vinyl acetate on polyalkylene oxide followed by saponification of the acetate groups to a layer of material which is closer to the source of light and another layer of material which is further removed from the source of light than the layer containing the magenta coupler, which additional layers contain gelatine in addition to the graft or copolymer.

The copolymers are obtained by the mutual polymerisation of vinyl acetate and at least one unsaturated carboxylic acid followed by saponification of the acetate groups. The saponification need not be quantitative, so that the copolymer may still contain acetate groups. Moreover, the copolymer may also contain other comonomers.

Preferred copolymers contain from 50 to 98 mol-% of vinyl alcohol units, from 0 to 20 mol-% of vinyl acetate units, from 2 to 30 mol-% of units of unsaturated carboxylic acids and from 0 to 30 mol-% of other comonomers.

The molecular weight $M_n$ should be at least 10,000.

Examples of suitable unsaturated carboxylic acids include acrylic acid, methacrylic acid, maleic acid, fumaric acid, crotonic acid and itaconic acid. Other suitable comonomers include vinyl chloride, vinylidene chloride, acrylates and methacrylates, ethylene, propylene, styrene, styrene sulphonic acid, vinyl phosphonic acid and vinyl sulphonic acid.

The graft polymers are described in DE-OS No. 3 541 162 and may be prepared by the methods indicated there. Saponification of the acetate groups is carried out by known methods.

The graft polymers preferably have the following structure

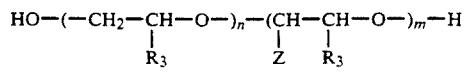

wherein $R_3$ stands for hydrogen or $C_1$–$C_2$-alkyl, preferably hydrogen, n stands for a value from 20–1000, preferably from 40–500, m stands for a value from 1–300, preferably from 2–100, and n>m, and Z stands for a copolymer of from 50 to 100 mol-% of vinyl alcohol, from 0 to 20 mol-% of vinyl acetate, from 0 to 30 mol-% of unsaturated carboxylic acids and from 0 to 30 mol-% of other comonomers.

The unsaturated carboxylic acids and the other comonomers of tile graft branches are the same as of the copolymers.

The following are examples of suitable vinyl alcohol copolymers and graft polymers:

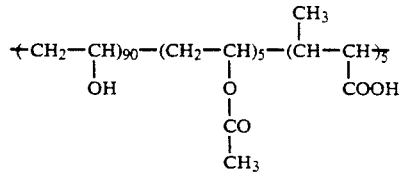

P1

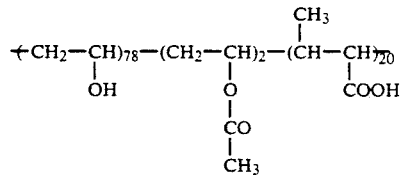

P2

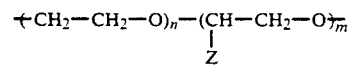

P3

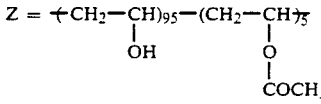

P4

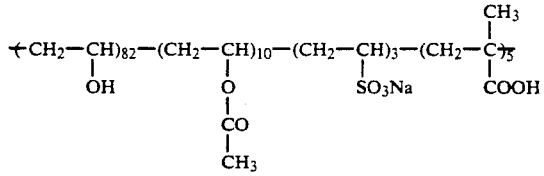

P5

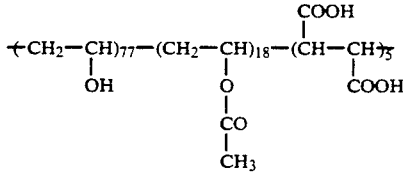

The polyalkylene oxide preferably corresponds to the following formula

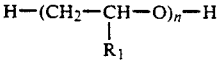

wherein $R_1$ stands for methyl or ethyl and n stands for a value from 20 to 2000.

Polyethylene oxide is preferred.

The graft polymer preferably contains from 2 to 50 mol-% of alkylene oxide, from 50 to 98 mol-% of vinyl alcohol and from 0 to 20 mol-% of vinyl acetate.

Pyrazolotriazole couplers are preferred pyrazoloazole couplers, in particular those corresponding to the following formula

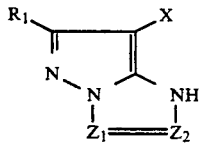

wherein

R stands for hydrogen, halogen, alkyl, aryl, a heterocyclic group, cyano, alkoxy, acyloxy, carbamoyloxy, acylamino or a polymer residue, X stands for hydrogen or a group which can be split off, one of the groups denoted by $Z_1$ and $Z_2$ is a nitrogen atom and the other is $CR_2$ and $R_2$ has the same meanings as $R_1$ and one of the groups $R_1$ and $R_2$ is a ballast group or substituted by a ballast group, which may be a polymer residue.

The following are suitable magenta couplers:

M-1

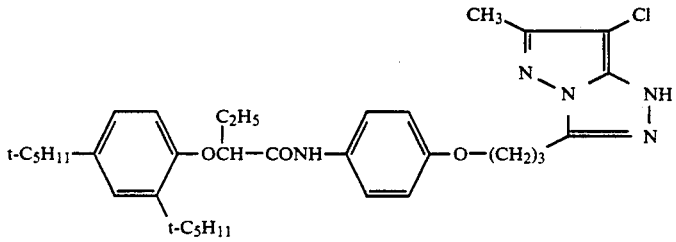

M-2

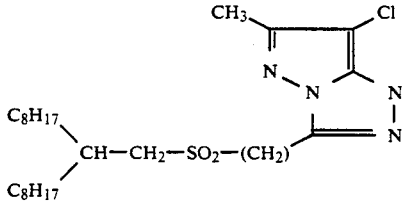

M-3

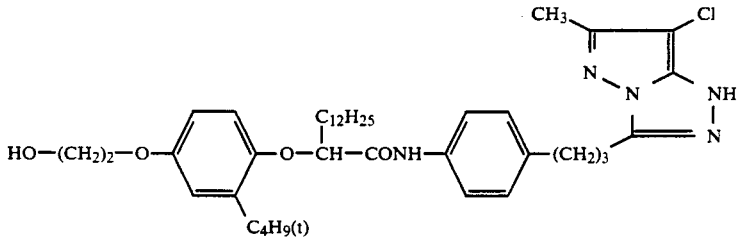

M-4

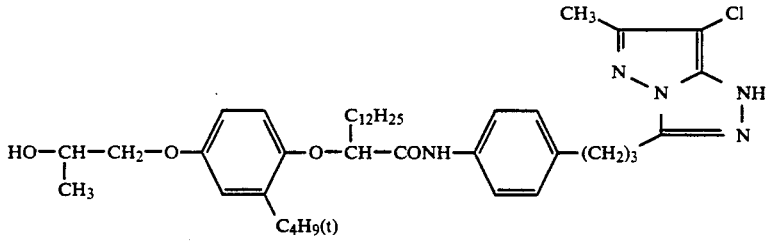

M-5

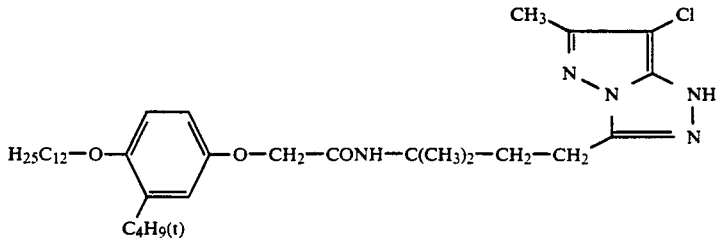

-continued
M-6
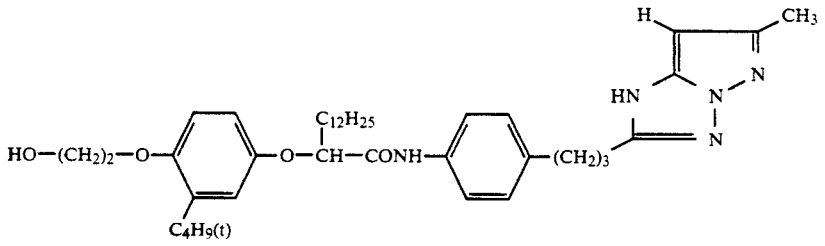
M-7
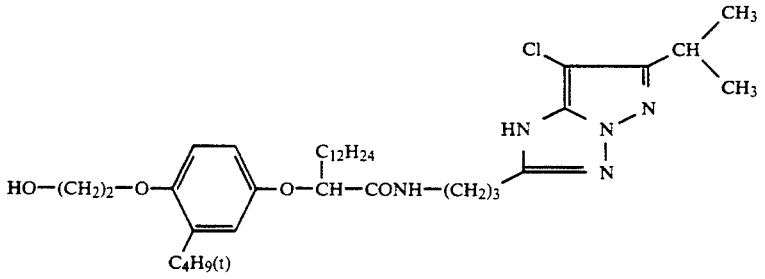
M-8
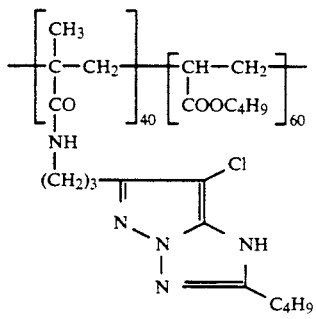
M-9
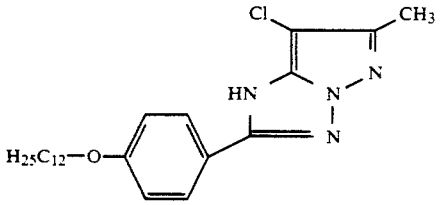
M-10
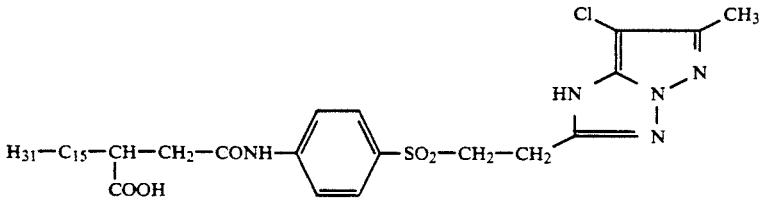
M-11
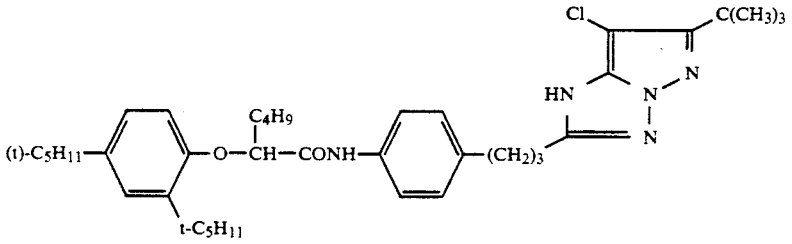

-continued

M-12

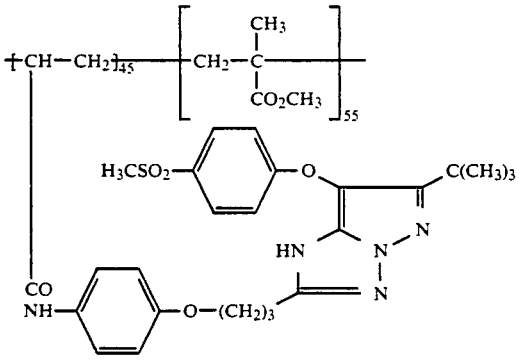

M-13

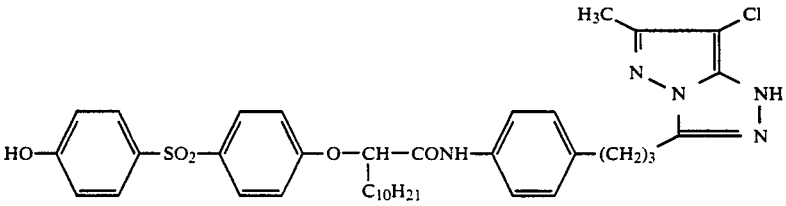

M-14

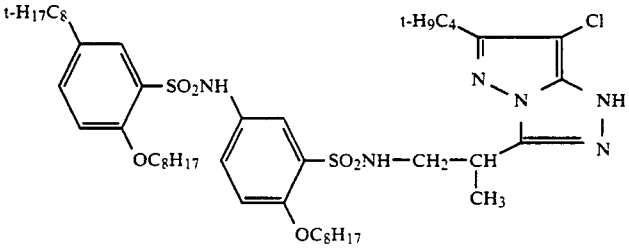

M-15

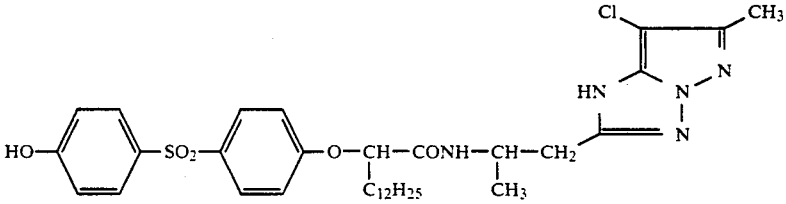

The graft of copolymer is preferably arranged in the layers immediately adjacent to the layer containing the magenta coupler.

The layers according to the invention preferably contain from 0.3 to 3.0 g of graft or copolymer and from 0.1 to 2.0 g of gelatine per $m^2$.

The material according to the invention is most preferably a material in which the following layers are arranged on a support in the sequence given: At least one blue-sensitive silver halide emulsion layer containing at least one yellow coupler, an interlayer, at least one green-sensitive silver halide emulsion layer containing at least one magenta coupler, an interlayer, at least one red-sensitive silver halide emulsion layer containing at least one cyan coupler and at least one protective layer, characterised in that the interlayer between the green-sensitive and the red-sensitive silver halide emulsion layer and the interlayer between the blue-sensitive and the green-sensitive silver halide emulsion layer are equipped in the manner according to the invention and the magenta coupler is a pyrazoloazole coupler.

The support may be reflective or transparent.

The silver halides of the silver halide emulsion layers containing colour couplers and of those free from colour couplers may be AgBr, AgBrCl, AgBrClI and AgCl.

The silver halides of all the light-sensitive layers including the interlayers according to the invention preferably contain at least 80 mol-% of chloride, in particular from 95 to 100 mol-% of chloride, from 0 to 5 mol-% of bromide and from 0 to 1% of iodide. The silver halide emulsions may be direct positive emulsions or, preferably, negative emulsions.

The silver halide may consist predominantly of compact crystals which may, for example, be regular cubes or octahedrons or they may have transitional forms. They may advantageously also contain twinned crystals, e.g. platelet shaped crystals, in which the average ratio of diameter to thickness is preferably at least 5:1, the diameter of a grain being defined as the diameter of a circle having an area equal to the projected area of the grain. The layers may also contain tabular silver halide crystals in which the ratio of diameter to thickness is greater than 5: 1, e.g. from 12: 1 to 30: 1.

The silver halide grains may also have a multilayered grain structure, in the simplest case with an inner and an outer core region (core/shell) which may differ from one another in their halide composition and/or by other modifications, e.g. doping of the individual grain regions. The average grain size of the emulsions is preferably from 0.2 μm to 2.0 μm and the grain size distribution may be either homodisperse or heterodisperse. The emulsions may contain organic silver salts in addition to the silver halide, e.g. silver benzotriazolate or silver behenate.

Two or more types of silver halide emulsions which have been prepared separately may be used as a mixture.

The photographic emulsions may be prepared from soluble silver salts and soluble halides by various methods (e.g. P Glafkides, Chimie et Physique Photographique, Paul Montel, Paris (1967), G. F. Duffin, Photographic Emulsion Chemistry, The Focal Press, London (1966), V. L. Zelikman et al, Making and Coating Photographic Emulsions, The Focal Press, London (1966)).

Precipitation of the silver halide is preferably carried out in the presence of the binder, e.g. gelatine, and may be carried out in an acid, neutral or alkaline pH, preferably with the addition of silver halide complex formers. Examples of the latter include ammonia, thioethers, imidazole, ammonium thiocyanate and excess halide. The water-soluble silver salts and the halides may be brought together either successively by the single jet process or simultaneously by the double jet process or by any combination of the two processes. They are preferably introduced at increasing injection rates but without exceeding the "critical" injection rate at which new nuclei just fail to be produced. The pAg range may vary within wide limits during precipitation and the so-called pAg controlled process is preferably used, in which the pAg is kept constant at a particular level or passed through a specified pAg profile during precipitation. Apart from the preferred method of precipitation with an excess of halide, so-called inverse precipitation using an excess of silver ions may be employed. The silver halide crystals may be made to grow not only by precipitation but also by physical ripening (Ostwald ripening) in the presence of excess halide and/or silver halide complex formers. The growth of the emulsion grains may even take place predominantly by Ostwald ripening, in which case a fine grained, so-called Lippmann emulsion is preferably mixed with a sparingly soluble emulsion and redissolved on the latter.

Precipitation of the silver halide grains may be carried out in the presence of so-called growth modifiers, i.e. substances which influence growth in such a manner that particular forms of grains and surfaces of grains result (e.g. 111 surfaces in the case of AgCl).

Salts or complexes of metals such as Cd, Zn, Pb, Tl, Bi, Ir, Rh, Fe, Pt, Pd, Ru or Os may be present during the precipitation and/or physical ripening of the silver halide grains for doping the silver halides.

Precipitation may also be carried out in the presence of sensitizing dyes. Complex forming agents and/or dyes may be rendered inactive at any stage, e.g. by an alteration in the pH or by an oxidative treatment.

The binder used is preferably gelatine but this .may be partly or completely replaced by other synthetic, semi-synthetic or naturally occurring polymers. Examples of synthetic gelatine substitutes include polyvinyl alcohol, poly-N-vinyl pyrrolidone, polyacrylamides, polyacrylic acid and derivatives thereof, in particular their copolymers. Naturally occurring gelatine substitutes include, for example, other proteins, such as albumin or casein, cellulose, sugar, starch or alginates. Semi-synthetic gelatine substitutes are generally modified natural products. Cellulose derivatives such as hydroxyalkyl cellulose, carboxymethyl cellulose and phthalyl cellulose as well as gelatine derivatives which have been obtained by a reaction with alkylating or acylating agents or by the grafting of polymerisable monomers are examples of these.

The binders should contain a sufficient quantity of functional groups so that sufficiently resistant layers can be produced by their reaction with suitable hardeners. These functional groups may in particular be amino groups but also carboxyl groups, hydroxyl groups and active methylene groups.

The gelatine, which is preferably used, may be obtained by acid or alkaline decomposition. The preparation of such gelatines is described, for example, in The Science and Technology of Gelatine, published by A. G. Ward and A. Courts, Academic Press 1977, pages 295 et seq. Whatever gelatine is used, it should be as free as possible from photographically active impurities (inert gelatine). Gelatines having a high viscosity and low swelling are particularly advantageous. The gelatine may be partly or completely oxidized.

After crystal formation has been completed or at an earlier stage, the soluble salts are removed from the emulsion, e.g. by shredding and washing, by flocculation and washing, by ultrafiltration or by means of ion exchangers.

The photographic emulsions may contain compounds for preventing fogging or for stabilizing the photographic function during production, storage or photographic processing.

Azaindenes are particularly suitable, especially tetra- and pentaazaindenes and in particular those which are substituted with hydroxyl or amino groups. Compounds of this type are described, e.g. by Birr, Z. Wiss. Phot. 47, (1952), pages 2–58. Salts of metals such as mercury or cadmium, aromatic sulphonic or sulphinic acids such as benzene sulphinic acid or nitrogen-containing heterocyclic compounds such as nitrobenzimidazole, nitroindazole, (substituted) benzotriazoles or benzothiazolium salts may be used as antifoggants. Heterocyclic compounds containing mercapto groups are particularly suitable, e.g. mercaptobenzothiazoles, mercaptobenzimidazoles, mercaptotetrazoles, mercaptothiadiazoles and mercaptopyrimidines. These mercaptoazoles may also contain a water-solubilizing group, e.g. a carboxyl group or a sulpho group. Other suitable compounds are disclosed in Research Disclosure No.17643 (1978), Section VI.

The stabilizers may. be added to the silver halide emulsions before, during or after ripening. The compounds may, of course, also be added to other photographic layers with which a silver halide layer is associated.

Mixtures of two or more of the above-mentioned compounds may be used.

The silver halide emulsions are normally chemically ripened, for example by the action of gold compounds or compounds of divalent sulphur.

The photographic emulsion layers or other hydrophilic colloid layers of the light-sensitive material prepared according to the invention may contain surface-active agents for various purposes, for example as coating auxiliaries, for preventing electric charging, for improving the slip properties, for emulsifying the dispersion, for preventing sticking and for improving the photographic characteristics (e.g. development acceleration, high contrast, sensitization, etc.).

Cyanine dyes are suitable sensitizing dyes, in particular those of the following classes:

Red sensitizers

Dicarbocyanines containing naphthothiazole or benzothiazole as basic end groups, which may be substituted in the 5- and/or 6-position by halogen, methyl or methoxy, or 9,11-alkylene-bridged, in particular 9,11-neopentylene-thiadiacarbocyanines containing alkyl or sulphoalkyl substituents on the nitrogen.

2. Green sensitizers

9-Ethyloxacarbocyanines which are substituted by chlorine or phenyl in the 5-position and carry alkyl or sulphoalkyl groups, preferably sulphoalkyl substituents, on the nitrogen of the benzoxazole groups.

3. Blue sensitizers

Methinecyanines containing benzoxazole, benzothiazole, benzoselenazole, naphthoxazole, or naphthothiazole as basic end groups which may be substituted by halogen, methyl or methoxy in the 5- and/or 6-position and carry at least one, preferably two sulphoalkyl substituents on the nitrogen. Apomerocyanines containing a rhodanine group are also suitable.

Sensitizers may be omitted when the silver halide has sufficient intrinsic sensitivity for a particular spectral region, for example the blue-sensitivity of silver iodobromides.

Non-diffusible monomeric or polymeric colour couplers may be associated with the differently sensitized emulsion layers. These colour couplers may be present in the same layer or in an adjacent layer. Cyan couplers are generally associated with the red-sensitive layers, magenta couplers with the green-sensitive layers and yellow couplers with the blue-sensitive layers.

Colour couplers for producing the cyan partial colour image are generally couplers of the phenol or α-naphthol series.

Couplers of the 5-pyrazolone or the indazolone series may be used as colour couplers for producing the magenta partial colour image in addition to the pyrazoloazole couplers required according to the invention.

Colour couplers for producing the yellow partial colour image are generally couplers containing an open chain ketomethylene group, in particular couplers of the α-acylacetamide series; e-benzoylacetanilide couplers and α-pivaloylacetanilide couplers are suitable examples of these.

The colour couplers may be 4-equivalent couplers or 2-equivalent couplers. The latter are derived from 4-equivalent couplers in that they carry, in the coupling position, a substituent which is split off in the coupling reaction.

The couplers normally contain a ballast residue to prevent diffusion within the material, i.e. both within a layer and from one layer to another. High molecular weight couplers may be used instead of couplers containing a ballast residue.

Suitable colour couplers and literature references in which these are described may be found in Research Disclosure 17643 (1978), Chapter VII.

High molecular weight colour couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284 and US-A-4 080 211. High molecular weight colour couplers are generally prepared by the polymerisation of ethylenically unsaturated monomeric colour couplers but they may also be obtained by polyaddition or polycondensation.

Incorporation of the couplers or other compounds in silver halide emulsion layers may be carried out by first preparing a solution, dispersion or emulsion of the particular compound and then adding this to the casting solution for the layer in which it is required. The choice of suitable solvent or dispersing agent depends on the solubility of the particular compound.

Methods of introducing compounds which are substantially insoluble in water by grinding processes are described, for example, in DE-A-26 09 741 and DE-A-26 09 742.

Hydrophobic compounds may also be introduced into the casting solution by means of high boiling solvents, so-called oil formers. Suitable methods are described, for example, in U.S. Pat. Nos. 2,322,027, 2,801,170, 2,801,171 and EP-A No. 0 043 037.

Oligomeric or polymeric compounds known as polymeric oil formers may be used instead of high boiling solvents.

The compounds may also be introduced into the casting solution in the form of loaded latices; see, for example, DE-A-25 41 230, DE-A-25 41 274, DE-A-28 35 856, EP-A-0 014 921, EP-A-0 069 671, EP-A-0 130 115 and U.S. Pat. No. 4,291,113.

The diffusion-fast incorporation of anionic water-soluble compounds (e.g. dyes) may also be carried out with the aid of cationic polymers, so-called mordant polymers.

The following are examples of suitable oil formers:

Phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

The following are examples of suitable oil formers: Dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl-p-hydroxy benzoate, diethyldodecanamide, N-tetradecylpyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octylaniline, paraffin, dodecylbenzene and diisopropylnaphthalene.

The photographic material may also contain UV light absorbent compounds, white toners, spacers, filter dyes, formalin acceptors, light protective agents, antioxidants, $D_{min}$ dyes, additives for improving the stabilization of dyes, couplers and whites and for reducing the colour fog, plasticizers (latices), biocides and others.

UV Light absorbent compounds should on the one hand protect the image dyes against bleaching by daylight rich in UV light and on the other hand function as filter dyes to absorb the UV light present in daylight during exposure and thereby improve the colour reproduction of a film. Compounds differing in structure are normally used for the two different functions. Examples include aryl substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4 045 229) and benzoxazole compounds (U.S. Pat. No. 3,700,455).

Ultraviolet absorbent couplers (such as cyan couplers of the α-naphthol series) and ultraviolet absorbent polymers may also be used. These ultraviolet absorbents may be fixed in a particular layer by mordants.

Filter dyes suitable for visible light include oxonole dyes, hemioxonole dyes, styryl dyes, merocyanine dyes, cyanine dyes and azo dyes. Among these, oxonole dyes, hemioxonole dyes and merocyanine dyes are particularly advantageous.

Suitable white toners are described, for example, in Research Disclosure 17 643 (December 1978), Chapter V, in U.S. Pat. No. 2,632,701 and 3,269,840 and in GB-A-852 075 and 1 319 763.

Certain layers of binders, in particular those furthest removed from the support but occasionally also interlayers, especially if they were furthest removed from the support during preparation of the material, may contain photographically inert particles of an inorganic or organic nature, e.g. as matting agents or as spacers (DE-A-33 31 542, DE-A-34 24 893 and Research Disclosure 17643 (December 1978), Chapter XVI).

The average particle diameter of the spacers may in particular be in the range of from 0.2 to 10 μm. The spacers are insoluble in water and may be soluble or insoluble in alkalies. Those which are soluble in alkalies are generally removed from the photographic material in the alkaline development bath. Examples of suitable polymers include polymethyl methacrylate, copolymers of acrylic acid and methyl methacrylate and hydroxypropyl methyl cellulose hexahydrophthalate.

Additives for improving the stability of the dyes, couplers and whites and for reducing the colour fog (Research Disclosure 17 643/1978, Chapter VII) may belong to the following classes of chemical substances: Hydroquinones, 6-hydroxychromans, 5-hydroxycoumarans, spirochromans, spiroindans, p-alkoxyphenols, sterically hindered phenols, gallic acid derivatives, methylene dioxybenzenes, aminophenols, sterically hindered amines, derivatives containing esterified or etherified phenolic hydroxyl groups, and metal complexes.

Compounds containing both a sterically hinder amine partial structure and a sterically hindered phenol partial structure in one and the same molecule (U.S. Pat. No. 4,268,593) are particularly effective in preventing any impairment (deterioration or degradation) of yellow colour images due to the development of heat, moisture or light. Spiroindans (JP-A-159 644/81) and chromans substituted by hydroquinone diethers or monoethers (JP-A-89 835/80) are particularly effective in preventing impairment (deterioration or degradation) of magenta colour images, in particular impairment (deterioration or degradation) due to the action of light.

The layers of the photographic material may be hardened with the usual hardeners, such as, for example, formaldehyde, glutaraldehyde and similar aldehyde compounds, diacetyl, cyclopentadione and similar ketone compounds, bis-(2-chloroethylurea), 2-hydroxy-4,6-dichloro- 1,3,5-triazine and other compounds containing reactive halogen (U.S. Pat. No. 3 288 775, U.S. Pat. No. 2 732 303, GB-A-974 723 and GB-A-1 167 207), divinylsulphone compounds, 5-acetyl-1,3-diacryloylhexahydro-1,3,5-triazine and other compounds containing a reactive olefin bond (U.S. Pat. Nos. 3,635,718, 3,232,763 and GB-A-994 869); N-hydroxymethylphthalimide and other N-methylol compounds (U.S. Pat. Nos. 2,732,316 and 2,586,168); isocyanates (U.S. Pat. No. 3,103,437); aziridine compounds (U.S. Pat. Nos. 3 017 280 and 2,983,611); acid derivatives (U.S. Pat. Nos. 2 725 294 and 2,725,295); compounds of the carbodiimide series (U.S. Pat. No. 3,100,704); carbamoylpyridinium salts (DE-A-22 25 230 and DE-A-24 39 551); carbamoyloxypyridinium compounds (DE-A-24 08 814); compounds containing a phosphorus-halogen bond (JP-A-113 929/83); N-carbonyloximide compounds (JP-A-43353/81); N-sulphonyloximido compounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole series (U.S. Pat. Nos. 3,321,313 and 3,543,292); halogenated carboxyaldehydes such as mucochloric acid; dioxane derivatives such as dihydroxydioxane and dichlorodioxane; and inorganic hardeners such as chrome alum and zirconium sulphate.

Hardening may be carried out in known manner by adding the hardener to the casting solution for the layer to be hardened or by coating the layer to be hardened with a layer containing a diffusible hardener.

The classes mentioned above include both slow acting and quick acting hardeners and so-called instant hardeners, which are particularly advantageous. Instant hardeners are compounds which cross-link suitable binders at such a rate that hardening is sufficiently advanced immediately after casting or at the latest after 24 hours, preferably after not more than 8 hours, that no further change in sensitometry and swelling of the combination of layers due to the cross-linking reaction can take place. Swelling is the difference between the wet layer thickness and the dry layer thickness of a film which is processed under aqueous conditions (Photogr. Sci., Eng. 8 (1964), 275; Photogr. Sci. Eng. (1972), 449).

These hardeners which react very rapidly with gelatine may be, for example, carbamoylpyridinium salts, which are capable of reacting with free carboxyl groups of gelatine so that the latter react with free amino groups of gelatine to form peptide bonds with concomitant cross-linking of the gelatine.

There exist diffusible hardeners which have an equal hardening action on all the layers within a combination of layers while other hardeners, which may be low molecular weight or high molecular weight compounds, are non-diffusible and limited in their action to the layer in which they are situated. These may be used to bring about exceptionally high cross-linking of individual layers, e.g. the protective layer. This is important when the silver halide layer is hardened only slightly due to the need to increase the silver covering power, so that it is necessary to use the protective layer for improving the mechanical properties (EP-A No. 0 114 699).

The colour photographic materials according to the invention are normally processed by development, bleaching, fixing and washing or stabilizing without subsequent washing; bleaching and fixing may be combined in a single step. The colour developer compounds used may be any developer compounds which in the form of their oxidation product are capable of reacting with colour couplers to form azomethine or indophenol dyes. Suitable colour developer compounds include aromatic compounds of the p-phenylenediamine series containing at least one primary amino group, for example, N,N-dialkyl-p-phenylenediamines such as N,N-diethyl-p-phenylenediamine, 1-(N-ethyl-N-methane sulphonamidoethyl)-3-methyl-p-phenylenediamine and 1-(N-ethyl-N-methoxyethyl)-3-methyl-p-phenylenediamine. Other suitable colour developers are described, for example, in J. Amer. Chem. Soc. 73, 3106 (1951) and G. Haist, Modern Photographic Processing, 1979, John Wiley and Sons, New York, pages 545 et seq.

Colour development may be followed by an acid short stop bath or by washing.

The material is normally bleached and fixed after colour development. The bleaching agents used may be, for example, Fe(III) salts and Fe(III) complex salts such as ferricyanides, dichromates, and water-soluble cobalt complexes. Iron(III) complexes of. aminopolycarboxylic acids are especially preferred, in particular, for example, the complexes of ethylene diaminotetracetic acid, propylene diaminotetracetic acid, diethylenetriaminopentacetic acid, nitrilotriacetic acid, iminodiacetic acid, N-hydroxyethyl-ethylenediaminotriacetic acid and alkyliminodicarboxylic acids and of suitable phosphonic acids. Persulphates and peroxides are also suitable bleaching agents, e.g. hydrogen peroxide.

The bleach fixing bath or fixing bath is in most cases followed by washing, which is carried out in counterflow or in several tanks, each with its own water supply.

Advantageous results may be obtained by following this treatment with a final bath containing little or no formaldehyde.

Washing may be replaced by a stabilizing bath, which is normally carried out in counterflow. When formaldehyde has been added, this stabilizing bath also assume the function of a final bath.

The colour photographic material according to the invention may also be subjected to a reversal development. In that case, colour development is preceded by a first development with a developer which does not form a dye with the couplers and a diffuse second exposure or a chemical fogging.

EXAMPLE

A colour photographic recording material was prepared by applying the following layers in the sequence given to a paper which was coated with polyethylene on both sides. The quantities are based on 1 $m^2$. The quantity of silver applied is given in terms of the corresponding quantity of $AgNO_3$.

Layer arrangement 1 (Comparison)

1st Layer (substrate layer)

0.2 g of gelatine

2nd Layer (blue-sensitive layer)

blue-sensitive silver halide emulsion (99.5 mol-% of chloride, 0.5 mol-% of bromide, average grain diameter 0.78 μm) from 0.50 g of $AgNO_3$ containing 1.38 g of gelatine 0.60 g of yellow coupler Y-1 and 0.48 g of tricresyl phosphate (TCP)

3rd Layer (interlayer)

1.18 g of gelatine 0.08 g of 2,5-dioctylhydroquinone and 0.08 g of dibutylphthalate (DBP)

4th Layer (green-sensitive layer)

green sensitized silver halide emulsion (99.5 mol-% of chloride, 0.5 mol-% of bromide, average grain diameter 0.37 μm) from 0.40 g of $AgNO_3$ containing 1.02 g of gelatine 0.37 g of magenta coupler M-1 and 0.40 g of DBP 5th Layer (interlayer)

1.20 g of gelatine 0.66 g of UV absorbent corresponding to the formula

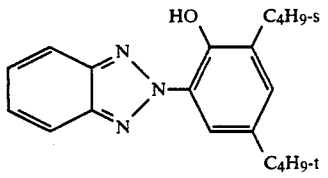

0.052 g of 2,5-dioctylhydroquinone and 0.36 g of TCP

6th Layer (red-sensitive layer)

red sensitized silver halide emulsion (99.5 mol-% of chloride, 0.5 mol-% of bromide, average grain diameter 0.35 μm) from 0.28 g of $AgNO_3$ containing 0.84 g of gelatine 0.39 g of cyan coupler C-1 and 0.39 g of TCP 7th Layer (UV protective layer)

0.65 g of gelatine 0.21 g of UV absorbent as in 5th layer and 0.11 g of TCP

8th Layer (protective layer)

0.65 g of gelatine and 0.39 g of hardener corresponding to the following formula:

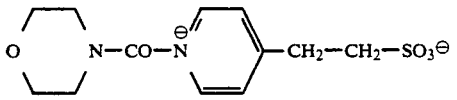

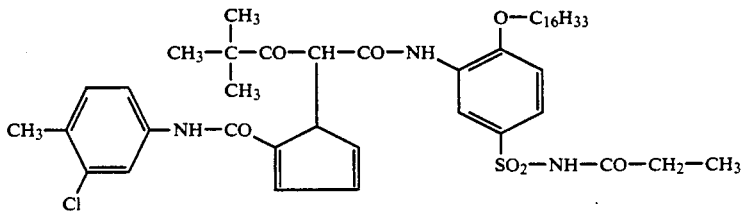

Y-1

-continued

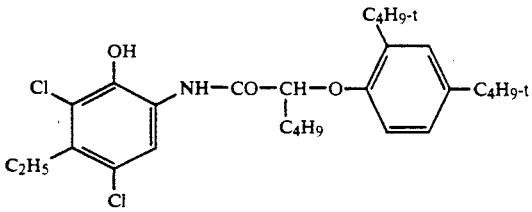

C-1

Layer arrangement 2 ( Comparison )

Same as layer arrangement 1 but with the following modifications:

Layer 3
0.59 g of gelatine and
1.77 g of polyvinyl alcohol

Layer arrangement 3 ( Comparison )

Same as layer arrangement 1 but with the following modifications:

Layer 3
0.59 g of gelatine and
1.77 g of polyvinyl alcohol
Layer 5
0.59 g of gelatine and
1.77 g of polyvinyl alcohol Layer arrangement 4 ( Comparison )

Same as layer arrangement 1 but with the following modifications:

Layer 3
0.59 g of gelatine and
1.77 g of Polymer P 1

Layer arrangement 5 ( Comparison )

Same as layer arrangement 1 but with the following modifications:

Layer 5
0.59 g of gelatine and
1.77 g of Polymer P 1

Layer arrangement 6 (according to the invention)

Same as layer arrangement 1 but with the following modifications:

Layer 3
0.59 g of gelatine and
1.77 g of Polymer P 1
Layer 5
0.59 g of gelatine and
1.77 g of Polymer P 1

Layer arrangement 7 (according to the invention)

Same as layer arrangement 1 but with the following modifications:

Layer 3
0.82 g of gelatine and
1.14 g of Polymer P 3
Layer 5
0.82 g of gelatine and
1.14 g of Polymer P 3

Layer arrangement 8 (according to the invention)

Same as layer arrangement 1 but with the following modifications:

Layer 2
1.12 g of gelatine and
1.18 g of Polymer P 3
Layer 5
0.82 g of gelatine and
1.14 g of Polymer P 3

Layer arrangement 9 (according to the invention)

Same as layer arrangement 1 but with the following modifications:

Layer 2
1.12 g of gelatine and
1.18 g of Polymer P 4
Layer 6
0.84 g of gelatine and
1.02 g of Polymer P 4

Layer arrangement 10 (according to the invention)

Same as layer arrangement 1 but with the following modifications:

Layer 3
0.82 g of gelatine and
1.14 g of Polymer P 3
Layer 7
0.65 g of gelatine and
0.65 g of Polymer P 3

Layer arrangement 11 (according to the invention)

Same as layer arrangement 1 but with the following modifications:

Layer 3
0.94 g of gelatine and
1.12 g of Polymer P 1
Layer 5
0.82 g of gelatine and
1.14 g of Polymer P 5.

The layer arrangements were subsequently exposed behind a graduated grey wedge. The materials were then processed in the usual manner in the processing baths indicated below.

The processed samples were then exposed to $4.2\times10^6$ Lux hours from a Xenon lamp which was standardized for daylight. The percentage loss of density for an initial density of 1.5 was then measured (Table 1).

The layer arrangements were also observed under obliquely incident light and the layers were assessed visually for their gloss (Table 1 ).

Table 1 shows that by using the polymers according to the invention in one layer above and one layer below the layer containing the magenta dye, the stability to light of the magenta dye is distinctly improved while the good transparency of the layers is preserved.

| | | |
|---|---|---|
| a) | Colour developer - 45 s - 35° C. | |
| | Triethanolamine | 9.0 g/l |
| | N,N-Diethylhydroxylamine | 4.0 g/l |
| | Diethylene glycol | 0.05 g/l |
| | 3-Methyl-4-amino-N-ethyl-N-methane-sulphonamidoethyl-aniline-sulphate | 5.0 g/l |
| | Potassium sulphite | 0.2 g/l |
| | Triethylene glycol | 0.05 g/l |
| | Potassium carbonate | 22 g/l |
| | Potassium hydroxide | 0.4 g/l |
| | Ethylene diaminotetracetic acid disodium salt | 2.2 g/l |
| | Potassium chloride | 2.5 g/l |
| | 1,2-Dihydroxybenzene-3,4,6-trisulphonic acid trisodium salt | 0.3 g/l |
| | made up with water to 1000 ml; | pH 10.0 |
| b) | Bleach fixing bath - 45 s - 35° C. | |
| | Ammonium thiosulphate | 75 g/l |

-continued

| | |
|---|---|
| Sodium hydrogen sulphite | 13.5 g/l |
| Ammonium acetate | 2.0 g/l |
| Ethylene diaminotetracetic acid (iron-ammonium salt) | 57 g/l |
| Ammonia, 25% by weight | 9.5 g/l |
| Acetic acid | 9.0 g/l |
| made up with water to 1000 ml; | pH 5.5 |
| c) Washing - 2 min - 35° C. | |
| d) Drying | |

TABLE 1

| Layer arrangement | Decrease in density in % after 4.2 · $10^6$ Lux hours | Gloss |
|---|---|---|
| 1 (Comparison) | 76 | transparent |
| 2 " | 78 | mat |
| 3 " | 20 | mat |
| 4 " | 75 | transparent |
| 5 " | 73 | transparent |
| 6 (according to the invention) | 12 | transparent |
| 7 " | 14 | " |
| 8 " | 18 | " |
| 9 " | 17 | " |
| 10 " | 18 | " |
| 11 " | 15 | " |

We claim:

1. Colour photographic recording material comprising a support, at least one light-sensitive silver halide emulsion layer containing a pyrazoloazole magenta coupler and at least one other layer arranged closer to the support and at least one other layer arranged further away from the support than the silver halide emulsion layer containing the pyrazoloazole magenta coupler, wherein these other layers contain gelatine and a graft polymer containing from 2 to 50 mol-% of alkylene oxide, from 50 to 98 mol-% of vinyl alcohol and form 0 to 20 mol-% of vinyl acetate.

2. Colour photographic recording material comprising a support, at least one light-sensitive silver halide emulsion layer containing a pyrazoloazole magenta coupler and at least one other layer arranged closer to the support and at least one other layer arranged further away from the support than the silver halide emulsion layer containing the pyrazoloazole magenta coupler, wherein these other layers contain gelatine and a graft polymer containing from 2 to 50 mol-% of alkylene oxide, from 50 to 98 mol-% of vinyl alcohol and from 0 to 20 mol-% of vinyl acetate and further wherein the pyrazoloazole magenta coupler corresponds to the formula

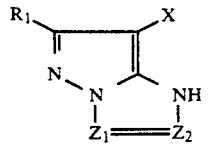

wherein $R_1$ stands for hydrogen, halogen, alkyl, aryl, a heterocyclic group, cyano, alkoxy, acyloxy, carbamoyloxy, acylamino or a polymer residue, X stands for hydrogen or a group which can be split off, one of the groups denoted by $Z_1$ and $Z_2$ is a nitrogen atom and the other is $CR_2$ and $R_2$ has the same meanings as $R_1$ and one of the groups $R_1$ and $R_2$ is a ballast group or substituted by a ballast group which may be a polymer residue.

3. Colour photographic recording material according to claim 2, wherein the other layers each contain from 0.3 to 3.0 g of graft polymer and from 0.1 to 2.0 g of gelatine/$m^2$.

4. Colour photographic recording material according to claim 2, wherein the silver halide of the silver halide emulsion layers contains at least 80 mol-% of silver chloride.

5. Colour photographic recording materials according to claim 2, wherein both said at least one other layer arranged closer to the support and said at least one other layer arranged further away from the support than the silver halide emulsion layer containing the pyrazoloazole magenta coupler are arranged so as to be immediately adjacent to and in contact with said silver halide emulsion layer containing the pyrazoloazole magenta coupler.

6. Colour photographic recording material comprising a support, at least one light-sensitive silver halide emulsion layer containing a pyrazoloazole magenta coupler and at least one other layer arranged closer to the support and at least one other layer arranged further away from the support than the silver halide emulsion layer containing the pyrazoloazole magenta coupler, wherein these other layers contain gelatine and a randomly structured or alternatingly structured copolymer of vinyl alcohol and an unsaturated carboxylic acid or a graft polymer of vinyl acetate on polyalkylene oxide with subsequent saponification of the acetate groups, further wherein both said at least one other layer arranged closer to the support and said at least one other layer arranged further away from the support than the silver halide emulsion layer containing the pyrazoloazole magenta coupler are arranged so as to be immediately adjacent to and in contact with said silver halide emulsion layer containing the pyrazoloazole magenta coupler.

* * * * *